US005522205A

United States Patent [19]

Weder

[11] Patent Number: 5,522,205

[45] **Date of Patent: *Jun. 4, 1996**

[54] METHOD FOR TRANSPORTING ITEMS IN A CARTON

[75] Inventor: Donald E. Weder, Highland, Ill.

[73] Assignees: The Family Trust U/T/A; Southpac Trust International, Inc., Highland, Ill.

[ * ] Notice: The term of this patent shall not extend beyond the expiration date of Pat. No. 5,092,465.

[21] Appl. No.: 271,409

[22] Filed: Jul. 6, 1994

Related U.S. Application Data

[63] Continuation-in-part of Ser. No. 242,485, May 13, 1994, which is a continuation-in-part of Ser. No. 202,058, Feb. 25, 1994, Pat. No. 5,411,137, which is a continuation of Ser. No. 93,109, Jul. 16, 1993, Pat. No. 5,311,992, which is a continuation-in-part of Ser. No. 892,441, Jun. 2, 1992, Pat. No. 5,240,109, which is a continuation of Ser. No. 831,767, Feb. 5, 1992, Pat. No. 5,148,918, which is a continuation of Ser. No. 692,329, Apr. 26, 1991, Pat. No. 5,092,465.

[51] Int. Cl.[6] ..... B65B 15/00; B65B 23/20; B65B 61/22

[52] U.S. Cl. ..... 53/475; 53/445; 53/157

[58] Field of Search ..... 53/475, 473, 443, 53/447, 448, 157, 445; 206/423, 813, 460, 445, 499, 45.19, 45.14

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren | 206/80 |
| 2,373,634 | 4/1945 | Wagner | 117/122 |
| 2,578,583 | 12/1951 | O'Brien | 206/65 |
| 2,707,352 | 5/1955 | Fischer | 47/58 |
| 2,744,624 | 5/1956 | Hoogstoel et al. | 206/65 |
| 2,871,080 | 1/1959 | Shelly | 312/107 |
| 3,113,673 | 12/1963 | Stein | 206/65 |
| 3,389,784 | 6/1968 | Hendricks et al. | 206/47 |
| 3,708,946 | 1/1973 | Cahill | 206/445 X |
| 3,734,280 | 5/1973 | Amneus et al. | 206/460 X |
| 3,883,990 | 5/1975 | Stidolph | 47/58 |
| 3,924,354 | 12/1975 | Gregoire | 47/34.11 |
| 4,053,049 | 10/1977 | Beauvais | 206/318 |
| 4,396,120 | 8/1983 | Morita | 206/460 |
| 4,470,508 | 9/1984 | Yen | 206/334 |
| 5,065,922 | 11/1991 | Harris | 206/423 X |
| 5,092,465 | 3/1992 | Weder et al. | 206/423 |
| 5,148,918 | 9/1992 | Weder et al. | 206/423 |
| 5,195,637 | 3/1993 | Weder | 206/423 |
| 5,240,109 | 8/1993 | Weder et al. | 206/423 |
| 5,255,784 | 10/1993 | Weder et al. | 206/423 |

FOREIGN PATENT DOCUMENTS

| | | | |
|---|---|---|---|
| 192843 | 11/1957 | Austria | 206/813 |
| 2221936 | 10/1974 | France . | |
| 4352664 | 12/1992 | Japan . | |
| 26878 | 11/1913 | United Kingdom | 206/813 |

*Primary Examiner*—James F. Coan
*Attorney, Agent, or Firm*—Dunlap & Codding

[57] ABSTRACT

A method for delivering an item or plurality of items to a predetermined destination. Packaging a plurality of items within a carton wherein the items are connectingly bonded to interior walls or inserts within the carton, and transporting the carton with the items disposed therein to the predetermined location. The items may be items of china, flower pots, vases or other similar items.

46 Claims, 8 Drawing Sheets

METHOD FOR TRANSPORTING ITEMS IN A CARTON

CROSS RELATED REFERENCES

This application is a continuation-in-part of U.S. Ser. No. 08/242,485, entitled "METHOD FOR TRANSPORTING FLORAL GROUPINGS, filed on May 13, 1994, which is a continuation-in-part of U.S. Ser. No. 08/202,058, titled RETAINING FLAP FOR SHIPPING CARTON, filed Feb. 25, 1994, now U.S. Pat. No. 5,411,137; which is a continuation of U.S. Ser. No. 08/093,109, titled RETAINING FLAP FOR SHIPPING CARTONS, filed Jul. 16, 1993, now U.S. Pat. No. 5,311,992; which is a continuation-in-part of U.S. Ser. No. 07/892,441, titled SHIPPING CARTON FOR FLORAL GROUPING ASSEMBLIES, filed Jun. 2, 1992, now U.S. Pat. No. 5,240,109; which is a continuation of U.S. Ser. No. 07/831,767, titled SHIPPING CARTON FOR FLORAL GROUPING ASSEMBLIES, filed Feb. 5, 1992, now U.S. Pat. No. 5,148,918; which is a continuation-in-part of U.S. Ser. No. 07/692,329, titled SHIPPING CARTON FOR FLORAL GROUPING ASSEMBLIES, filed Apr. 26, 1991, now U.S. Pat. No. 5,092,465.

BACKGROUND

The present invention is related to methods for transporting various items such as china, particularly wherein the items are bondingly connected to a surface of a carton for minimizing movement and disturbance of the items during transportation.

DESCRIPTION OF THE INVENTION

Figure 1:
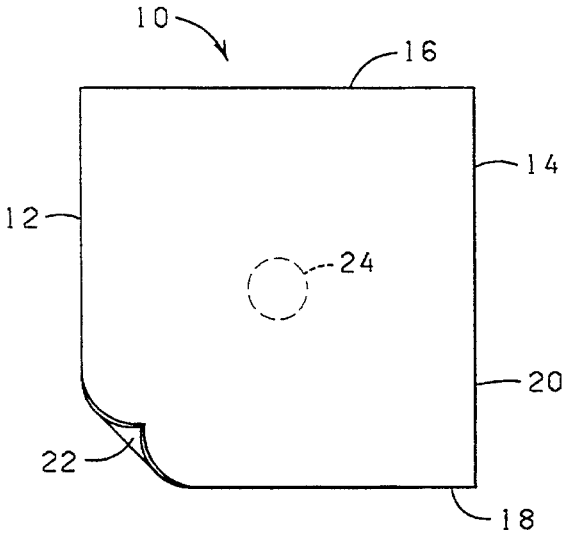
FIG. 1 is a plan view of a sheet of material constructed for use in accordance with the present invention.
Figure 2:
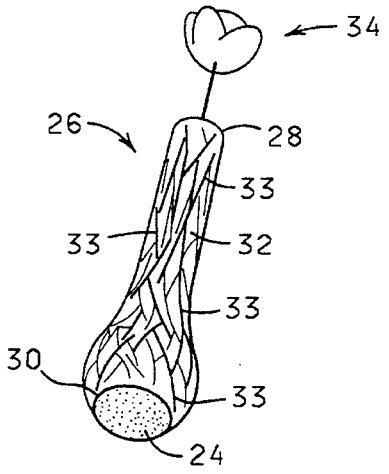
FIG. 2 is an oblique perspective view of a vase for use in accordance with the present invention.

The present invention in one version comprises a method for delivering a plant package to a predetermined destination such as a florist shop or grocery store. The method includes the steps of (1) providing a support surface, (2) providing a plurality of plant packages, each plant package comprising a floral container and a floral grouping disposed within the floral container, wherein each floral container has an exterior bottom surface upon which is disposed a connecting bonding material, (3) disposing each plant package on the support surface and causing the bonding material on the exterior bottom surface of the plant package to engage and bondingly connect to the support surface via the connecting bonding material, thereby positioning the plant package in a substantially vertical orientation, and (4) transporting the support surface with the plant packages bondingly connected thereto to the predetermined destination. The plant packages may then be sold, repackaged, or subjected to further processing.

Alternatively, the support surface may further comprise a second connecting bonding material disposed upon a portion thereof for cooperating with the connecting bonding material of the floral container to assist in bondingly connecting the floral container to the support surface.

The connecting bonding material of the floral container and the second connecting bonding material of the support surface are preferably cohesive materials. Preferably, the support surface is the interior bottom surface of a box or carton.

The floral container may be an uncovered pot means, or one contained within an external decorative or protective covering such as a flower pot cover. Or, the floral container may be a vase constructed, for example, from a sheet of material and once formed comprises a plurality of overlapping connected folds.

When the floral container is a vase, the vase may further comprise, an upper end, a closed lower end having a bottom, an upper end opening, and a peripheral wall extending from the closed lower end to the upper end, the peripheral wall having an outer surface and an inner surface which encompasses and defines an inner space. The bottom of the closed lower end has an outer surface continuous with the outer surface of the peripheral wall and an inner surface continuous with the inner surface of the peripheral wall, and the peripheral wall preferably comprises a plurality of folds in the sheet of material with adjacent portions of at least some of the folds being connected via a bonding material to form connected folds, which connected folds cooperate to maintain the vase in the shape of a vase.

Further, when the floral container is a vase, the sheet of material may be defined further as being constructed of a material and have a thickness whereby the formed vase is flexible and may be substantially flattened and unflattened to assume the original shape of the formed vase without substantial loss of the preformed shape thereby providing the flexible, yet shape-sustaining nature of the formed vase. The vase may be further defined as being shaped whereby the formed vase includes a skirt extending a distance from the upper end thereof.

Also, when the container is a vase, the plurality of overlapping folds may comprise a substantial number folds which extend at arbitrary angles to a vertical direction and at arbitrary angles to a horizontal direction and extend over different and arbitrary distances. The method may also comprise the additional step of removing the plant packages from the support surface at the predetermined destination. Also, the floral container may further comprise a floral holding material or growth medium disposed within the interior space of the floral container. In other embodiments, the sheet of material may have a label disposed thereon. In addition, the sheet of material may have a bonding material for enabling a label, note, card, or other information delivery means to be attached to the sheet of material. The container may further comprise a release strip for covering the bonding material prior to use of the bonding material to engage a surface.

The sheet of material used to form the container may further comprise a sheet extension which extends from the upper end of the sheet of material after the sheet of material has been formed into a vase. When present, such a sheet extension serves as a protective wrap about a portion of the floral grouping.

The present invention is also drawn to a method for preparing a plant package assembly for transport to a predetermined destination. The method has the steps of (1) providing a support surface, (2) providing a plurality of floral containers, each floral container having an exterior bottom surface upon which is disposed a connecting bonding material, (3) disposing each floral container on the support surface and causing the bonding material on the exterior bottom surface of the floral container to engage and bondingly connect to the support surface via the connecting bonding material, thereby positioning the floral container in a substantially vertical orientation, (4) providing a plurality of floral groupings, and (5) disposing at least a portion of a floral grouping into each floral container, thereby forming a plant package comprising a floral grouping and a floral container, the plant packages and the support surface together comprising the plant package assembly ready for transport to the predetermined destination.

Another version of the invention contemplates the plant package assembly itself which is prepared for transport to a predetermined destination, the assembly comprises a support surface, and a plurality of vertically oriented plant packages which are bondingly connected to the support surface. Each plant package further comprises, a floral container which has an exterior bottom surface upon which is disposed a connecting bonding material for bondingly connecting the floral container to the support surface in a vertical orientation. The floral container is bondingly connected via the connecting bonding material to the support surface such that the floral container is positioned in a substantially vertical orientation. Each plant package also comprises a floral grouping having a stem end. At least a portion of the stem end of the floral grouping is disposed within the floral container. The floral container may have a floral holding material disposed therein.

In another embodiment, the present invention comprises a method for delivering an item to a predetermined destination. In the first step a carton is provided. The carton has a plurality of side walls, a bottom and an interior space and has at least one bonding surface which has a connecting bonding material disposed upon a portion thereof. In the next step, an item is provided. The item has an exterior surface engageable with the connecting bonding material. The item is then disposed within the interior space of the carton and adjacent the bonding surface of the carton. The exterior surface of the item is caused to engage the connecting bonding material of the adjacent bonding surface thereby bondingly connecting the item to the adjacent bonding surface, rendering the item substantially immobile within the interior space of the carton. Finally, the carton with the item contained therein is transported to the predetermined destination.

In this method, the item may further comprise a second connecting bonding material disposed upon a portion of the exterior surface thereof for cooperating with the connecting bonding material of the bonding surface to bondingly connect the item to the bonding surface. The second connecting bonding material may be an adhesive or cohesive. The bonding surface of the carton may be one or more inserts or interior walls disposed within the interior space of the carton with the connecting bonding material disposed upon a surface of the insert or interior wall. The item may be an item of china, a flower pot means, a vase or any other item which is fragile, requires an upright orientation during shipment, or which would benefit from the degree of immobilization provided using the invention described herein during delivery, shipment or transport. The method may comprise the additional step of removing the item from the carton after the carton has been delivered to the predetermined destination. The method may comprise the additional step of disposing a packing material within the container for cushioning the item contained therein. The carton may further comprise a release strip for covering the connecting bonding material prior to use of the connecting bonding material to connectingly bond to an item disposed within the interior space of the carton. Additionally, the connecting bonding material may be further defined as an adhesive or cohesive, more particularly, a pressure-sensitive adhesive or cohesive. Further, at least one of the side walls may have a connecting bonding material disposed upon an inner surface thereof for bondingly connecting to the item.

In another embodiment, the present invention contemplates a method for delivering an item of china to a predetermined destination. The method comprises the steps of providing a carton having a plurality of side walls, a bottom and an interior space, and providing at least one insert or interior wall. The insert has a bonding surface having a connecting bonding material disposed upon a portion thereof. At least one item of china is then provided. The item of china has an exterior surface engageable with the connecting bonding material of the bonding surface of the insert for connecting the item to the bonding surface of the insert. Next, the insert is disposed into the interior space of the carton.

The item of china is then disposed into the interior space of the carton adjacent the insert or interior wall in a position near the connecting bonding material of the insert. A portion of the exterior surface of the item of china is then caused to engage and connectingly bond to the connecting bonding material on the insert whereby the item is rendered substantially immobile within the interior space of the carton. Finally, the carton with the items of china disposed therein is transported to the predetermined destination. Optionally, the insert may be adapted to fit the contour of at least a portion of the exterior surface of the item of china to be bondingly connected thereto.

In an alternative version of the method of transporting an item of china, the step of disposing the insert into the container and rendering the item substantially immobile within the interior space of the carton may occur after the item of china has been bondingly connected to the connecting bonding material on the insert. In yet another version of this method, the item of china may be disposed into the interior space of the carton prior to disposing the insert into the carton. The insert is then disposed within the carton adjacent the item of china wherein the connecting bonding material of the insert is disposed adjacent the exterior surface of the item of china and bondingly connected thereto.

In another version of a method for delivering an item of china to a predetermined destination, the carton provided may have a plurality of exterior side walls, a bottom, an interior space, and a plurality of interior walls formed from one or more inserts disposed within the interior space of the carton. At least some of the interiors walls have a bonding surface with a connecting bonding material disposed upon a portion thereof. In the next step, a plurality of items of china is provided. Each item, as before, has an exterior surface engageable with the connecting bonding material of the bonding surface of an interior wall. Each of the items of china to be transported is disposed into the interior space of the carton with the exterior surface of the item of china adjacent the bonding surface of an interior wall and wherein a portion of the exterior surface of the item of china is caused to engage and bondingly connect to the connecting bonding material on the interior wall. Each item of china is thereby rendered substantially immobile within the interior space of the carton. As before, the carton with the items of china disposed therein is transported to the predetermined destination.

Embodiments of FIGS. 1–12

The various embodiments of the invention will be described in more detail below. Shown in FIG. 1 and designated by the general reference numeral 10 is a sheet of material constructed in accordance with the present invention. The sheet 10 has a first outer edge 12, a second outer edge 14, a third outer edge 16, a fourth outer edge 18, a first surface 20 and a second surface 22. A bonding material 24 is disposed upon a portion of the second surface 22, preferably near the center of the second surface 22. The sheet of material 10 may be formed into a container such as the vase designated by the general reference numeral 26 in FIG. 2 by using the method described in U.S. Pat. No. 4,773,182. The vase 26 has an upper end 28, a lower end 30, an outer peripheral surface 32, a plurality of overlapping folds 33 and in general has a floral grouping 34 disposed within the vase 26. The vase 26 in FIG. 2 the bonding material 24 is disposed upon a portion of the lower end 30 of the vase 26. The bonding material 24 may be covered by a release strip (not shown) which covers the surface of the bonding material 24 and which can be removed from the bonding material 24 to expose the bonding material 24 for bondingly connecting to a support surface when desired.

The sheet of material 10 may have a thickness in a range of from about 0.1 mils to about 30 mils. Preferably, the sheet of material 10 has a thickness in a range from about 0.2 mils to about 10 mils. More preferably, the sheet of material 10 has a thickness of from about 0.5 mils to about 5 mils.

The sheet of material 10 may be any shape and a square or rectangular shape is shown in FIG. 1 only by way of example. The sheet of material 10, may, for example, be square, rectangular, circular or any other geometric shape such as heart-shaped, or any other shape which enhances the function of the sheet for the purpose disclosed herein.

The sheet of material 10 may be constructed of a single layer of material or a plurality of layers of the same or different types of materials. Any thickness of the sheet of material 10 may be utilized in accordance with the present invention as long as the sheet of material 10 is wrappable about a vase, in particular a bud vase, as described herein. The layers of material comprising the sheet of material 10 may be connected together or laminated or may be separate layers.

The sheet of material 10 may be used in conjunction with a second sheet of material (not shown) which may be sized the same or smaller than the sheet 10. If used, the second sheet of material has a thickness in a range from 0.1 mils to about 30 mils and preferably in a range from about 0.2 mils to about 10 mils. The second sheet of material is flexible, but may be somewhat more rigid compared to the first sheet of material 10.

The sheet of material 10 may further comprise a sheet extension which extends from the upper end of the sheet of material after the sheet of material has been formed into a vase wherein the sheet extension (not shown) serves as a protective wrap about the floral grouping.

The vases described herein may be constructed using a method described in U.S. Pat. No. 4,773,182 which is hereby specifically incorporated herein by reference in its entirety. Another method of forming a vase which can be used in accordance with the present invention is described in U.S. Pat. No. 5,176,609 which is hereby incorporated herein in its entirety by reference. A vase thus formed comprises a plurality of overlapping folds which are substantially vertically oriented and are Z-shaped in cross section and wherein the peripheral wall of the container further comprises a plurality of flat panels which comprise substantially no folds.

Other examples of vases formed from sheets of material can be found in the specification of the U.S. patent application titled "Vase for Containing a Floral Grouping", filed by Donald E. Weder on May 13, 1994, under the Express Mail Number TB379042587 US, Attorney Docket Number 8401.493, the specification of which is hereby incorporated herein by reference.

By "vase" is meant a vessel, substantially higher than it is wide, which is used to hold a floral grouping or other decoration. More particularly, the height of the vase is generally at least three to five times greater than the narrowest diameter. When used herein the term "bud vase" refers to a vase for holding just one to several cut flowers or buds.

The term "vase" refers to any type of container used for holding a floral grouping or single floral cuttings. "Floral grouping" as used herein means cut fresh flowers, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

The sheet of material 10 and the second sheet of material (if used) may be constructed of a single layer of material or a plurality of layers of the same or different types of materials. Any thickness of the sheet of material 10 may be utilized in accordance with the present invention as long as the sheet of material 10 may be formed into a vase for containing a floral grouping, in the manner described herein. Additionally, an insulating material such as bubble film, preferable as one of two or more layers, can be utilized in order to provide additional protection for the item contained in the vase.

In a preferred embodiment, the sheet of material 10 is constructed from two polypropylene films laminated together (e.g. a polypropylene film such as Mobil 220 AB clear film laminated to a sheet of Mobil 270 ABW white opaque film). The sheet of material 10 is constructed from any suitable wrapping material that is capable of being formed into a vase for containing a floral grouping. Preferably, the sheet of material 10 comprises a paper (untreated or treated in any manner), cellophane, foil, polymer film, fabric (woven or nonwoven or synthetic or natural), burlap, or combinations thereof. The term "polymer film" means a man-made polymer such as a polypropylene or a naturally occurring polymer such as cellophane. A polymer film is relatively strong and not as subject to tearing (substantially non-tearable), as might be the case with paper or foil.

The sheet of material 10 may vary in color. Further, the sheet of material 10 may consist of designs or decorative patterns which are printed, etched, and/or embossed thereon using inks or other printing materials. An example of an ink which may be applied to the surface of the sheet of material 10 is described in U.S. Pat. No. 5,147,706, entitled "Water Based Ink On Foil And/Or Synthetic Organic Polymer", issued to Kingman on Sep. 15, 1992 and which is hereby incorporated herein by reference. In addition, the sheet of material 10 may have various colorings, coatings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper and/or lower surface of the sheet of material 10 or to near the upper end 16 or to near the lower end 18 of the sheet 10. Moreover, each surface of the sheet of material 10 may vary in the combination of such characteristics. The sheet of material 10 itself may be opaque, translucent or partially clear or tinted transparent.

The sheet of material 10 may also be constructed in part, from a cling material. "Cling Wrap or Material" when used herein means any material which is capable of connecting to itself upon contacting engagement during the wrapping process and is wrappable about an item whereby portions of the cling material contactingly engage and connect to other portions of another material, or, alternatively, itself, for generally partially forming a portion of a vase.

The cling material is constructed and treated if necessary, from polyethylene such as Cling Wrap made by Glad®, First Brands Corporation, Danbury, Conn. The cling material will range in thickness from less than about 0.1 mils to about 10 mils, and preferably less than about 0.5 mils to about 2.5 mils and most preferably from less than about 0.6 mils to about 2 mils. However, any thickness of cling material may be utilized in accordance with the present invention which permits the cling material to function as described herein.

Figure 3:
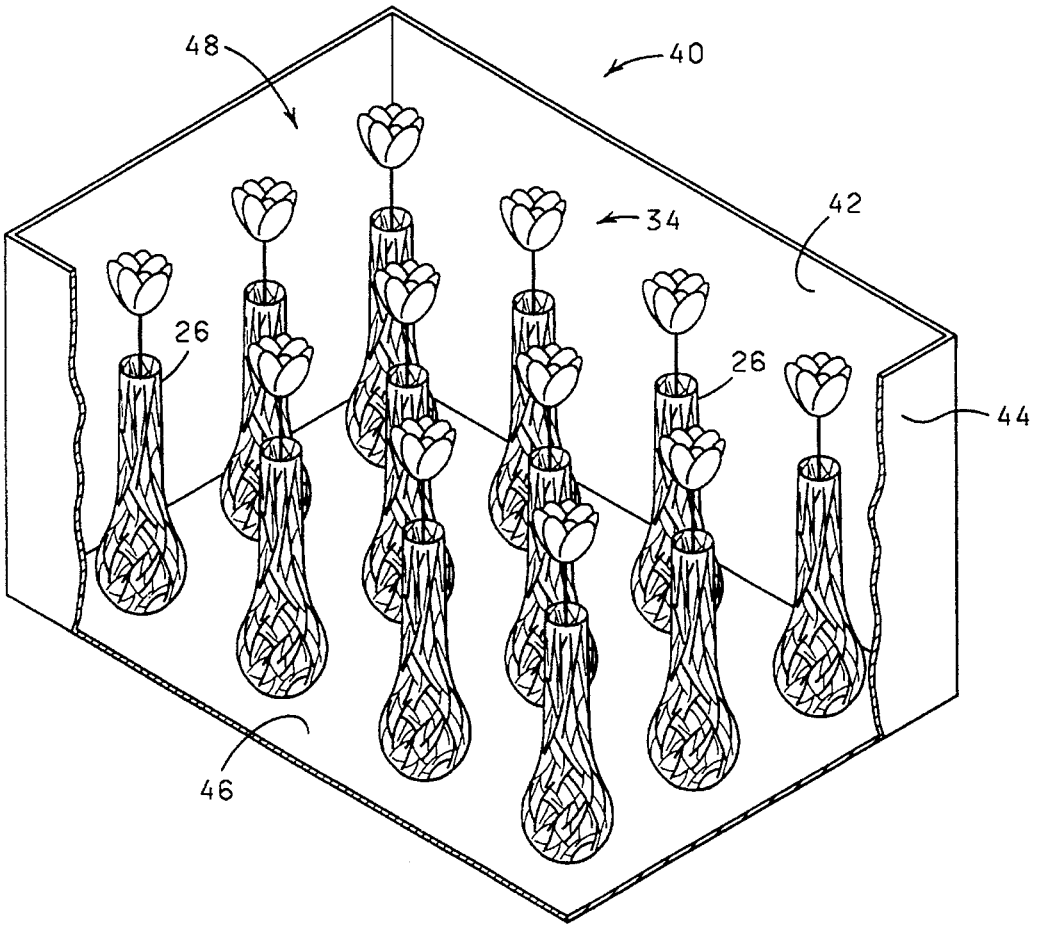
FIG. 3 is a partial cut away view of a carton containing a plurality of vases for transport in accordance with the present invention.

Shown in FIG. 3 is a plurality of vases such as the vase 26 disposed in a vertical orientation within a carton 40. A carton 40 has an inner peripheral side surface 42, an outer peripheral surface 44, an inner bottom surface 46, and an inner retaining space 48 which is defined by the inner peripheral side surface 42 and the inner bottom surface 46. As is seen in FIG. 3 the plurality of vases 26 are connectingly bonded to the inner bottom surface 46 via the connecting bonding material 24 on the bottom surface of the lower end 30 of the vase 26. Each vase 26 then is firmly anchored in an upright vertical orientation upon the surface 46 in the carton 40 via the bonding material 24. It will be appreciated by one of ordinary skill in the art that the vase shapes displayed herein are but a small sample of the great variety of shapes of vases which may be formed to function in accordance with the present invention.

Figure 4:
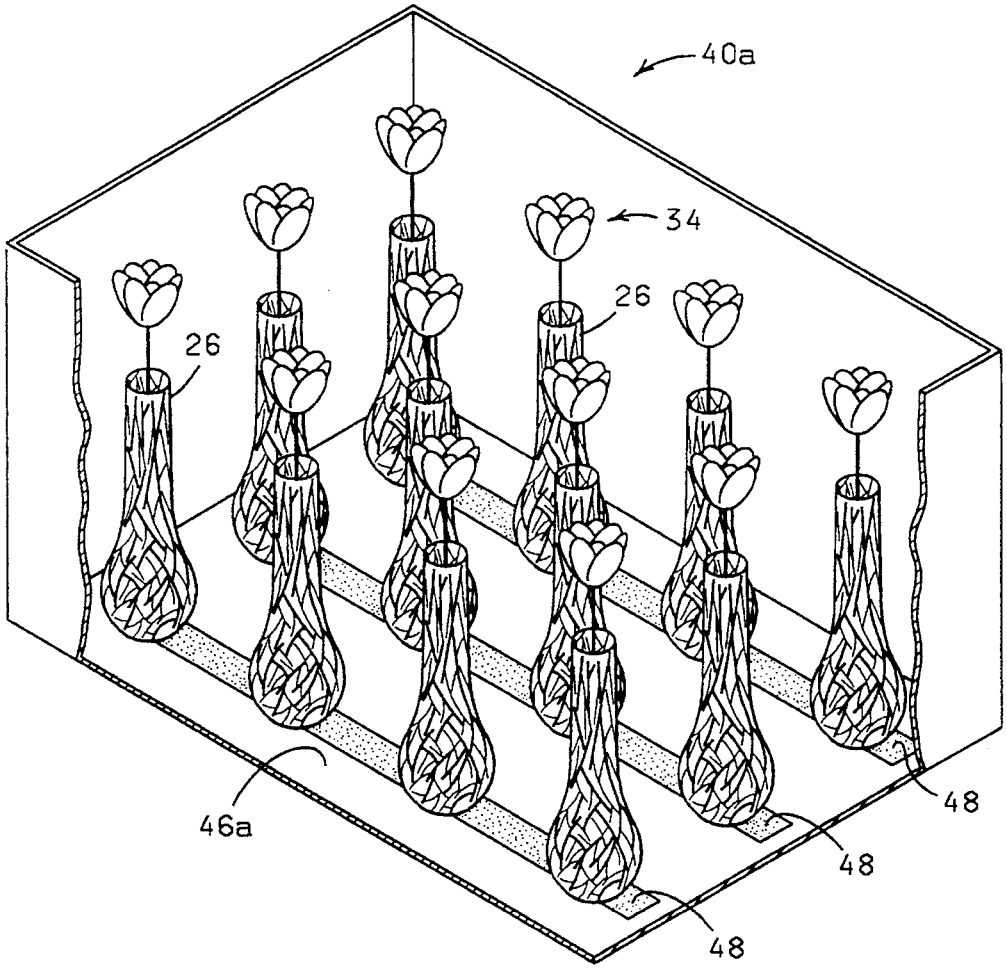
FIG. 4 is a partial cut away view of another carton used in accordance with the present invention.

The plurality of vases 26 with the floral groupings disposed therein are now ready for delivery or shipment to another location. Shown in FIG. 4 and designated by the general reference numeral **40*a* is an alternate version of the container for containing a plurality of floral containers such as the vase 26. The carton 40*a* has a inner bottom surface 46*a* having thereon a plurality of at least one bonding strip 48 for adhering a vase such as vase 26 which is exactly the same as the vase described above except that it does not have a bonding material 24 on the bottom surface thereof. Although the bonding material 48 is shown in FIG. 4 as comprising a continuous strip, the bonding material may instead be disposed upon the support surface 46*a*** in any other geometric form or pattern including spots or designs. One method for disposing a bonding material on the sheet of material, in this case an adhesive or cohesive, is described in U.S. Pat. No. 5,111,637, entitled "Method For Wrapping A Floral Grouping", issued to Weder et al., on May 12, 1992 and which is hereby incorporated herein by reference.

The term "bonding material or bonding means" when used herein means an adhesive, frequently a pressure sensitive adhesive, or a cohesive or any other bonding material which functions as a bonding material in accordance with the invention described herein. When the bonding material is a cohesive, a similar cohesive material must be present on the surface which the vase will be disposed on to be bondingly contacted and bondingly connected with the cohesive material.

Figure 5:
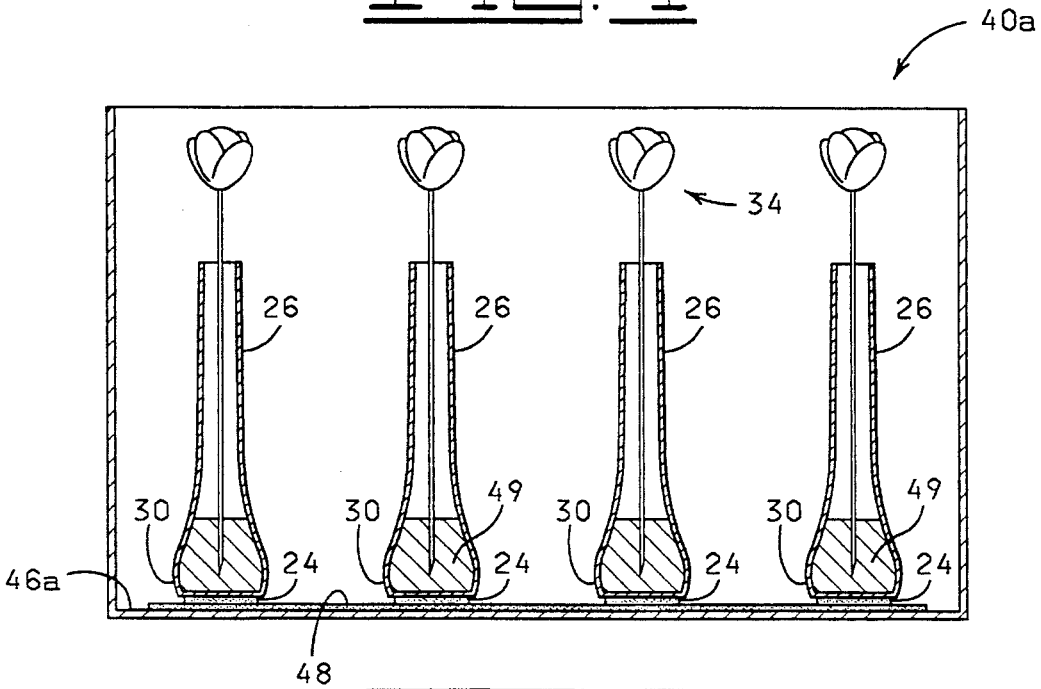
FIG. 5 is a side sectional view of a plurality of vases bondingly connected to a support surface of a carton.

Shown in FIG. 5 is an example of a carton **40*a* which is exactly the same as the carton 40*a* described in FIG. 4 except that the strip of bonding material 48 on the inner bottom surface 46*a* is not an adhesive but is a cohesive material which cohesively binds or bonds to a cohesive material defined as the bonding material 24 on the lower surface on each of the vases 26 disposed in the carton 40*a***.

A floral holding medium (such as foam) 49 is shown disposed within the inner space of the vase 26 and functions to hold a portion of the floral grouping 34, for providing moisture or nutrients, or for providing additional weight to the vase 26 described herein to counterbalance the floral grouping 34. The floral holding medium 49 may further comprise a growing medium for extending the life of the floral grouping 34 disposed within the inner space of the vase 26. Such floral holding materials 49 are well known to those of ordinary skill in the art and are commercially available.

The floral grouping 34 generally comprises a bloom portion and a stem portion. Further, the floral grouping 34 may comprise a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores. The floral holding material 49 is added to the vase after the vase has been constructed.

Figure 6:
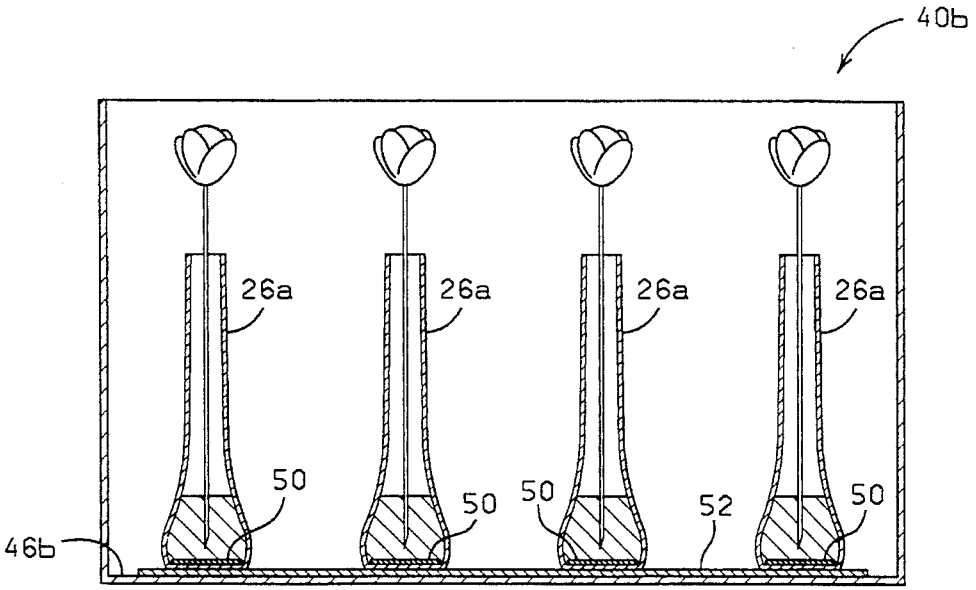
FIG. 6 is a side sectional view of a plurality of vases magnetically adhered to a support surface of a carton.

FIG. 6 shows another version of the carton, the carton designated therein by the general reference number 40*b*. The carbon 40*b* has an inner bottom surface 46*b*. Shown in FIG. 6 is a vase designated by the general reference numeral 26*a* which has a metallic plate or strip disposed on the inner bottom surface 46*b* of the vase 26*a*. An example of a magnetic strip is that which is commercially available and which has an adhesive backing for attaching to a surface. Also disposed on the inner bottom surface 46*b* is a metallic strip 52. It can be seen in the FIG. 6 then that each vase 26*a* is disposed in a vertical position wherein the magnetic plate 50 of the vase 26*a* magnetically engages the magnetic strip 52 of the surface 46*b* for maintaining the vase 26*a* in a vertical orientation optimal for delivery. It will be understood by one of ordinary skill in the art that any number of types of floral containers may be anchored in a carton using the technology discussed herein. For example, a plant cover such as that designated by the general reference numeral 62 covers a potted plant 58 having disposed therein a floral grouping 60. Disposed on the bottom end 64 of the plant cover 62 is a bonding material 66 for enabling the plant package 56 to be adhesively or bondingly engaged to the inner bottom surface 46 of the carton 40 for ease of transport.

Figure 7:
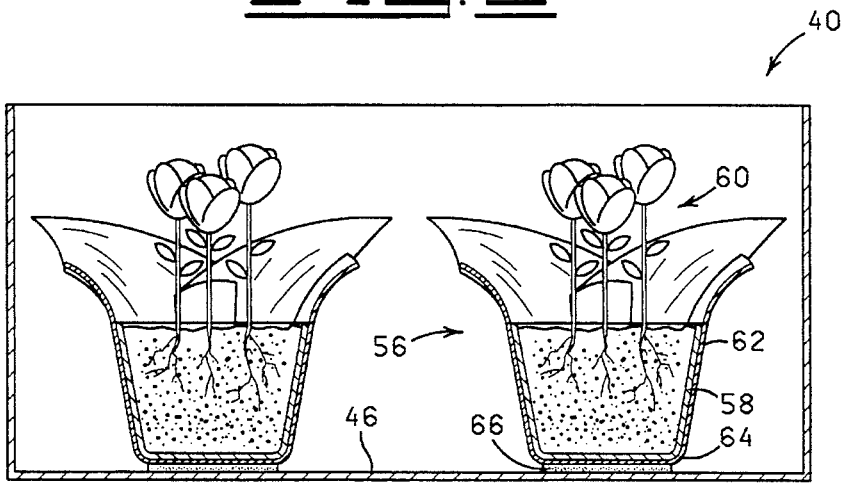
FIG. 7 is a side sectional view of a plurality of flower pots bondingly connected to a support surface.
Figure 8:
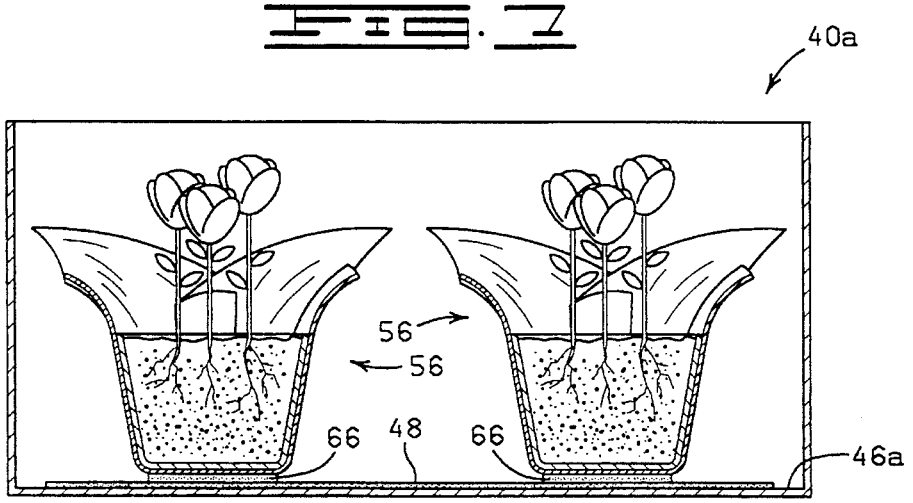
FIG. 8 is a side sectional view of a plurality of flower pots connected to a support surface in an alternate manner.
Figure 9:
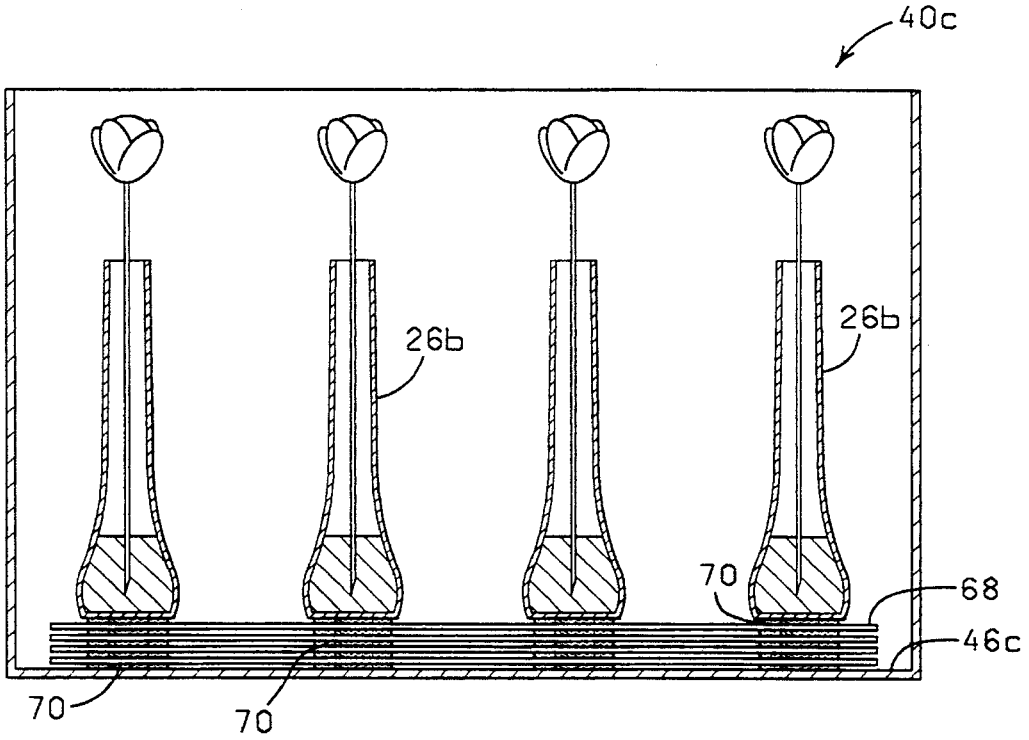
FIG. 9 is a side sectional view of an alternate version of the support surface of the present invention.

Shown in FIG. 8 is a carton which is exactly the same as the carton 40*a* described in FIG. 4 showing a plant package 56 similar to the plant package 56 of FIG. 7 but which has disposed on the lower surface thereof a bonding material 66 which comprises a cohesive material for bonding to a cohesive material 48 which is disposed upon the inner bottom surface 46*a* of the carton 40*a*.

In an alternative embodiment of the present invention, a carton 40*c* comprises a plurality of sheets 68 which have disposed thereon a plurality of portions of bonding material 70 which may be an adhesvie for causing the bonding of a floral container such as the floral container 26*b* shown in the figure for maintaining the floral container in a vertical orientation during delivery or shipment.

After one or more usages of the bonding material on the sheet 68, the sheet 68 may be removed from the carton thus revealing a fresh sheet 68 with fresh bonding material 70 which has not been used thereby free of various accumulated materials which may affect the bonding ability of the bonding material 70, and thereby its ability to maintain the vases in a vertical orientation.

Figure 10:
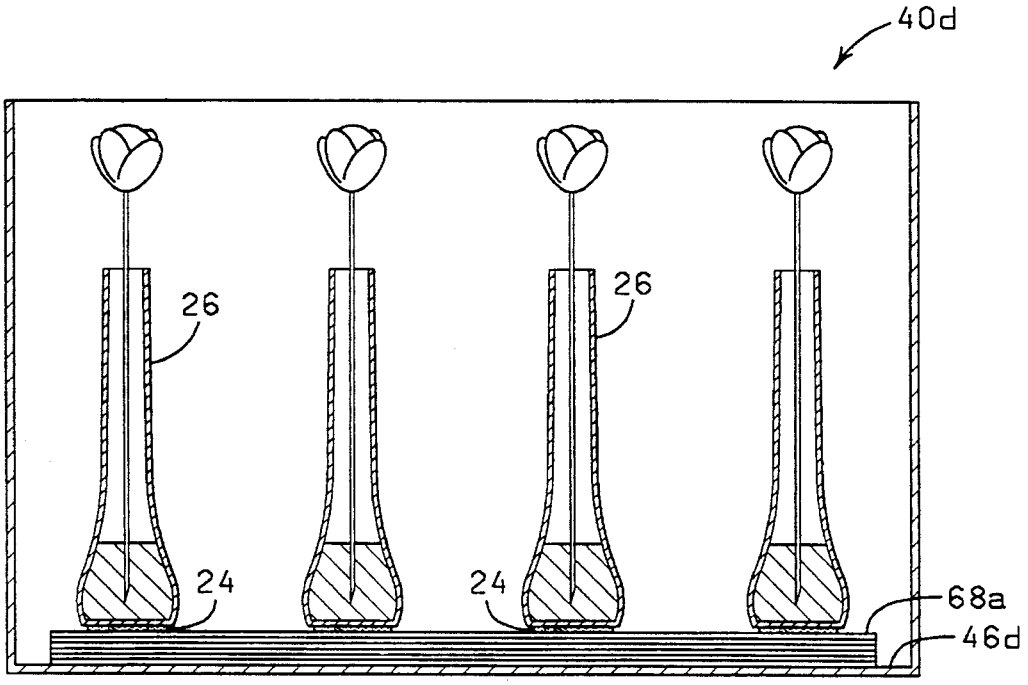
FIG. 10 is a side sectional view of yet another version of the support surface of the present invention.

Shown in FIG. 10 is an alternative version of the carton designated by the general reference numeral 40*d*. The carton 40*d* has disposed upon the inner bottom surface 46*d* a plurality of sheets of material 46*a*. None of the sheets of material have bonding material disposed thereon for bonding to floral containers disposed within the carton. However, the carton 40*d* can be used to contain a plurality of containers such as those shown as FIG. 26 having a bonding material 24 disposed upon the bottom surface of the floral container 26. A number of floral containers 26 can thus be shipped and vertically stored in the container 40*d*. Once each sheet 68*a* has been soiled or otherwise rendered inoperable, the upper sheet 68*a* can be removed revealing a fresh sheet for use in storing and shipping the floral containers 26.

Figure 11:
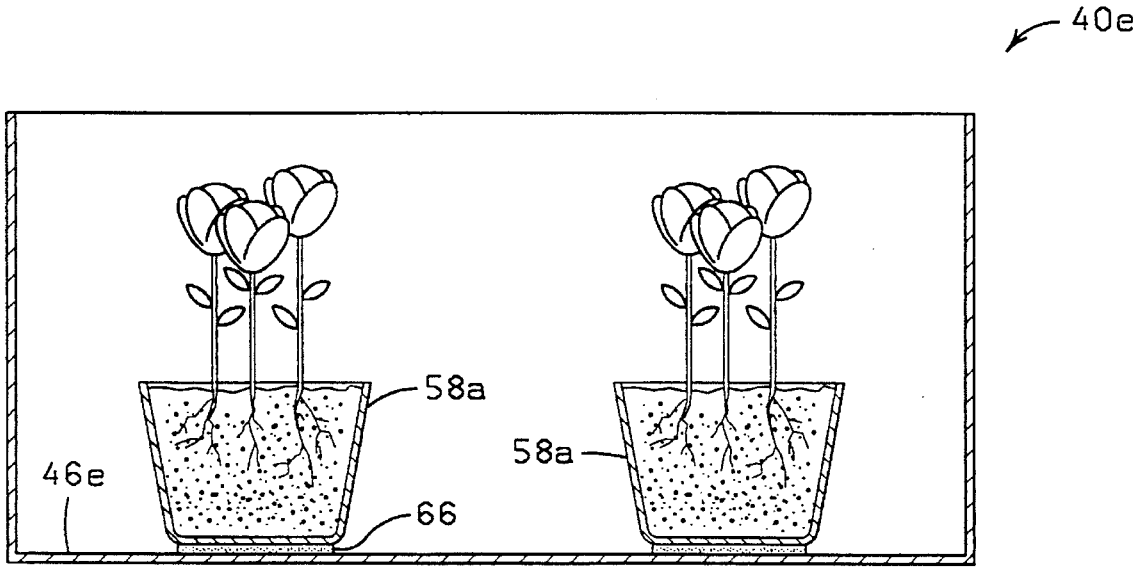
FIG. 11 is a side sectional view of a plurality of uncovered flower pots bonded to a carton.

Shown in FIG. 11 and designated by the general reference numeral 40*e* is a carton exactly the same as carton 40 of FIG. 7 with the exception that the carton 40*e* has a bottom surface 46*e* and contains a plurality of flower pots 58*a* which are bondingly connected via the bonding material 66 to the inner bottom surface 46*e* of the carton 40*e*. Unlike the pots 58 of FIG. 7 which are covered by a decorative cover 62, the pots 58*a* are not decoratively covered or at least have an uncovered bottom surface and therefore are bonded directly to the inner bottom surface 46*e* which serves as the bonding surface for the carton 40*e*. The bonding material 66 may be disposed either on the inner bottom surface 46*e* of the carton 40*e* in the manner of FIG. 4 or upon the bottom surface of the pot 58*a* in the manner of FIG. 3.

Figure 12:
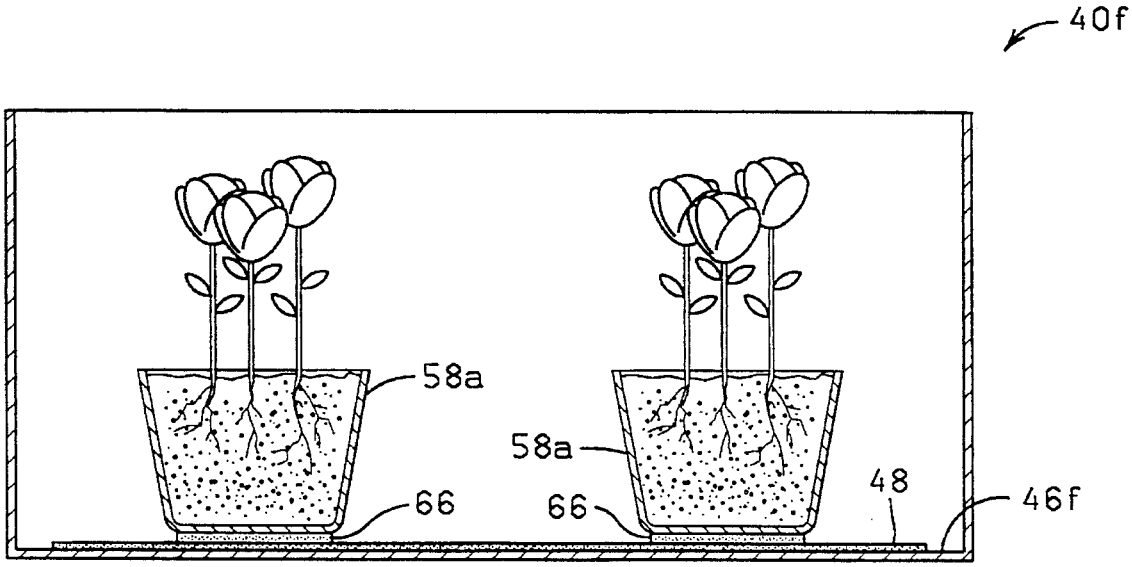
FIG. 12 is a side sectional view of a plurality of uncovered flower pots bonded to a carton in another manner.

Shown in FIG. 12 and designated by the general reference numeral 40*f* is a carton which is exactly the same as carton 40*a* in FIGS. 4 or 8, and which has an inner bottom surface 46*f*, except that disposed therein instead are a plurality of flower pots 58*a* which are bare of decorative covers or are uncovered, at least on the bottom surface of the pot 58*a*. Carton 40*f* has a bonding material 48 disposed upon a portion of the inner bottom surface 46*f*. The flower pot 58*a* has a bonding material 66 disposed upon the bottom surface thereof. In the embodiment contemplated herein, the bonding materials 48 and 66 are both cohesive materials which when caused to engage one another, bondingly connect to each other in the same manner as the version shown in FIG. 8.

Embodiments of FIGS. 13–18

Figure 13:
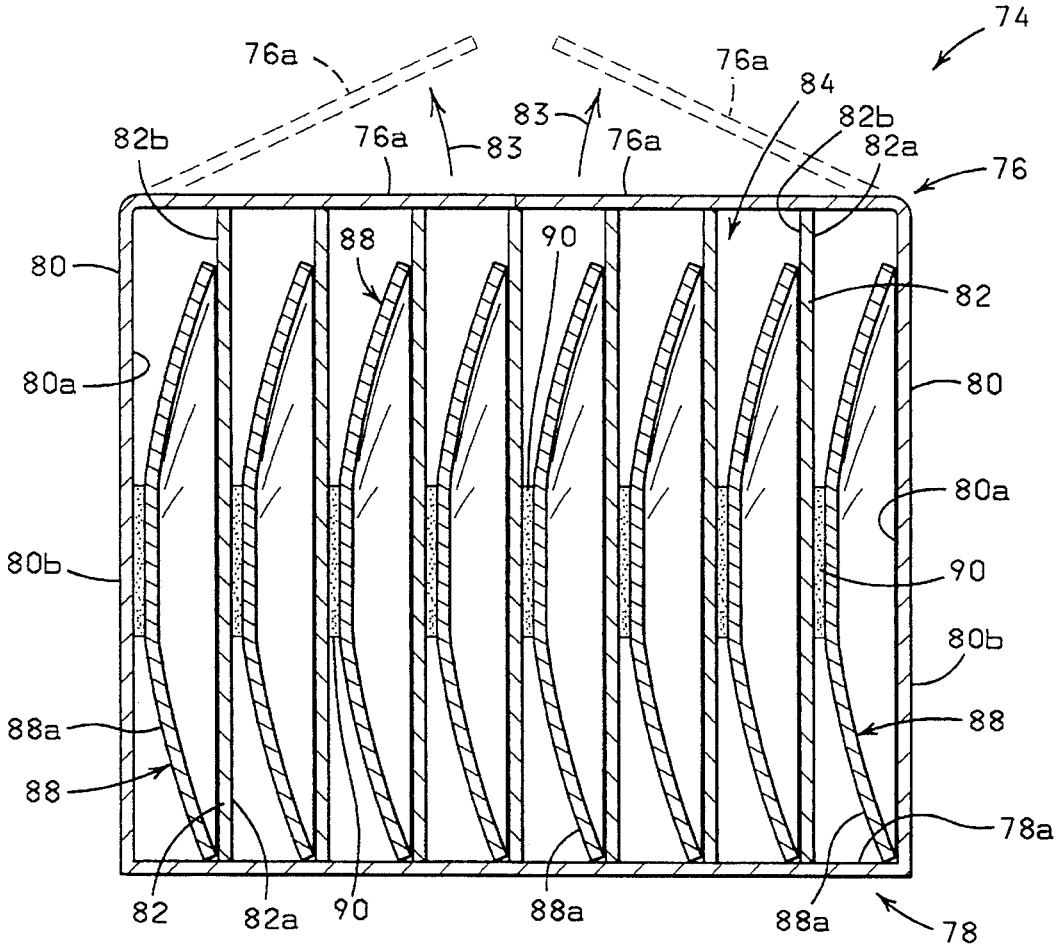
FIG. 13 is a side sectional view of a plurality of items of china bondingly connected to a plurality of support surfaces within a carton.

Shown in FIG. 13 is a carton designated by the general reference numeral 74. Carton 74 has an upper end 76, a lower end 78, an inner bottom surface 78*a*, a plurality of side walls 80, and a plurality of interior walls 82 (only two of which are designated there as in FIG. 13). The upper end 76 may comprise one or more flaps 76*a* which are shown in FIG. 13 in a closed position but when lifted in a direction 83 can be opened into an open position shown by phantom flaps 76*a* in FIG. 13. Each side wall 80 has an interior surface 80*a* and an exterior surface 80*b*. Each interior surface 80*a* of each side wall 80 faces an interior space 84 of the carton 74. Each interior wall 82, also referred herein as an insert, has a first surface 82*a* and a second surface 82*b*. Each first surface 82*a* and second surface 82*b* faces a portion of the interior space 84.

Each interior wall or insert 82 may comprise only a first and a second surface, 82*a* and 82*b* respectively, or may comprise a plurality of surfaces (not shown). Each interior wall 82 is preferably connected in some manner to the inner bottom surface 78*a* or inner surface 80*a* of a side wall 80 for immobilizing the interior wall 82 within the interior space 84 of the carton 74. The carton 74 functions to immobilizingly hold one or more items of china designated herein by the general reference numeral 88 for transportation to a predetermined destination, which may be a store, a warehouse, a processing facility, a customer or intermediate destination, or any other destination from a china manufacturing facility. As defined herein, the term china includes everyday dishes, cups, plates, bowls, vases, trays, pitchers and other similar household table items and may be made from plastic, ceramic, glass, metal, porcelain or other materials used to manufacture such items. Each item of china 88 has at least one exterior surface 88*a*. The invention contemplates a bonding material 90 which serves to connect the item of china 88 to a portion of one of the surfaces 82*a* or 82*b* of the interior wall 82 as shown in FIG. 13.

The bonding material 90 may be disposed either on the surface 82*a* of the interior wall 82 or on the exterior surface 88*a* of the item of china 88. A bonding material may be disposed both on the surface 82*a* of the interior wall 82 and on the exterior surface 88*a* of the item of china 88 wherein when the two bonding materials engage one another, the bonding surface 90 is formed. The carton 74 as shown in FIG. 13 contains a plurality of items of china 88 bondingly connected via bonding materials 90 to surfaces 82*a* of the interior walls 82 in the interior space 84. The items of china 88 are rendered substantially immobile within the carton 74, and may be further cushioned, protected, or immobilized by packing material (not shown) disposed within the interstices of the carton 74. Such packing materials are well known to those of ordinary skill in the art. The items of china 88 can be disposed into the interior space 84 of the carton 74 using several procedures. In one method the interior walls 82, with the bonding material 90 disposed thereon, can be inserted first into the carton 74. The individual items of china 88 can then be inserted between adjacent interior walls 82, such that a portion of the exterior surface 88*a* of the item of china 88 is disposed adjacent the bonding material 90 on the surface 82*a* of the interior wall 82. The item of china 88 is then caused in some way to engage the bonding material 90 wherein the item of china 88 is bondingly connected to the interior wall 82 and rendered immobile thereby. Alternatively, the item of china 88 can be bondingly connected to the interior wall (or insert) 82 before the interior wall is disposed within the interior space 84 of the carton. Alternatively, the item of china 88 can be placed into the carton 74 prior to insertion of the interior wall 82. The item of china 88 can be caused to bondingly connect to the interior wall 82 either by pressing the item of china 88 against the interior wall 82, by pressing the interior wall 82 against the item of china 88, or by the force of friction as the exterior surface 88*a* of the item of china 88 slides against the bonding surface of the interior wall 82. After the carton 74 with the items of china 88 have been transported to the predetermined destination, the items of china 88 can be removed by disconnecting them from the bonding surfaces of the interior walls 82 to which they are connected.

Figure 14:
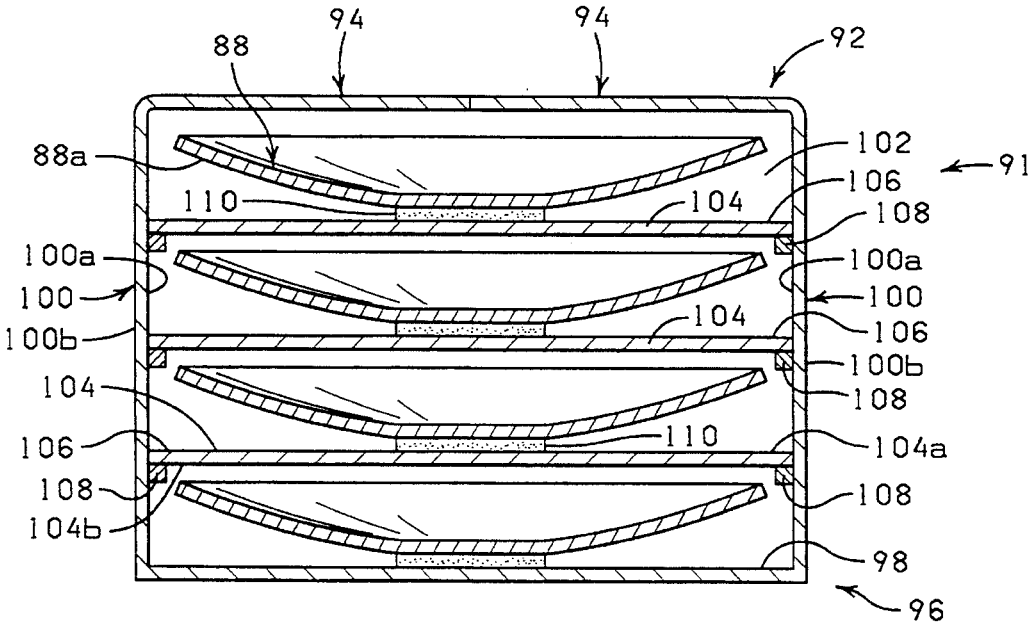
FIG. 14 is a side sectional view of a plurality of items of china bondingly connected to a plurality of surfaces of a carton in an alternate manner.

FIG. 13 shows the items of china 88 disposed in a vertical orientation within the interior space 84 of the carton 74. Shown in FIG. 14 is an alternate version of the invention wherein a carton is designated by the general reference numeral 91. The carton 91 comprises an upper end 92, a lower end 96 having an inner bottom surface 98, a plurality of side walls 100, an interior space 102, and a plurality of interior support surfaces 104, which may be variously referred to herein as shelves, inserts, interior walls or interior support surfaces. The insert 104 is referred to as a shelf 104 in the present case because the insert or wall is disposed horizontally. Each upper end 92 may comprise one or more flaps 94 such as the flaps 76*a* of carton 74. Each side wall 100 has an interior surface 100*a* and an exterior surface 100*b*. Each shelf 104 has an upper surface 104*a*, which comprises a support surface for supporting an item of china 88, and a lower surface 104*b*. Each shelf 104 also comprises at least one edge 106, and more preferably two edges 106 for resting upon one or more rails 108 which are connected to the interior surface 100*a* for supporting an insert or shelf 104, as shown in FIG. 14. A bonding material 110 may be disposed either on the upper surface 104*a* of the shelf 104 or on the exterior surface 88*a* of the item of china 88, or both, for bondingly connecting the item of china 88 to the upper surface 104*a* of the shelf 104. The carton 91 may be provided with the shelves 104 already disposed therein. Alternatively, the items of china 88 and shelves 104 may be disposed alternately. For example, an item of china 88 may be bondingly connected to the inner bottom surface 98. A shelf 104 may then be inserted into the interior space 102 of the carton 91 in a position suspended on rails 108 above the item of china 88. Another item of china 88 may then be bondingly connected to the shelf 104 and this sequence of steps may be continued until the desired number of items of china 88 is disposed in the carton 91. Alternatively, each item of china 88 may be bondingly connected to the shelf 104 before the shelf 104 is positioned within the carton 91. One of ordinary skill in the art will also appreciate that the interior walls 82 or 104 of cartons 74 and 91 may be disposed in orientations other than strictly vertical or horizontal. For example, a shelf or interior wall may be arranged at an angle between 0° and 90° to accommodate an item of china of a particular shape, or to accommodate a plurality of items of china of different types. It may also be desired to have interior walls, some of which are vertical and some of which are horizontal, and also some which are at angles to the vertical and horizontal walls. For any of the embodiments described herein, it may be desired that a combination of different items of china be transported within a single carton. For example, one may desire to bondingly connect plates, bowls, saucers and cups to a single, or to different shelves within the same carton. It may further be desired to provide interior walls or shelves which are shaped or adapted to fit the contours of the various items of china to be contained in the carton.

Figure 15:
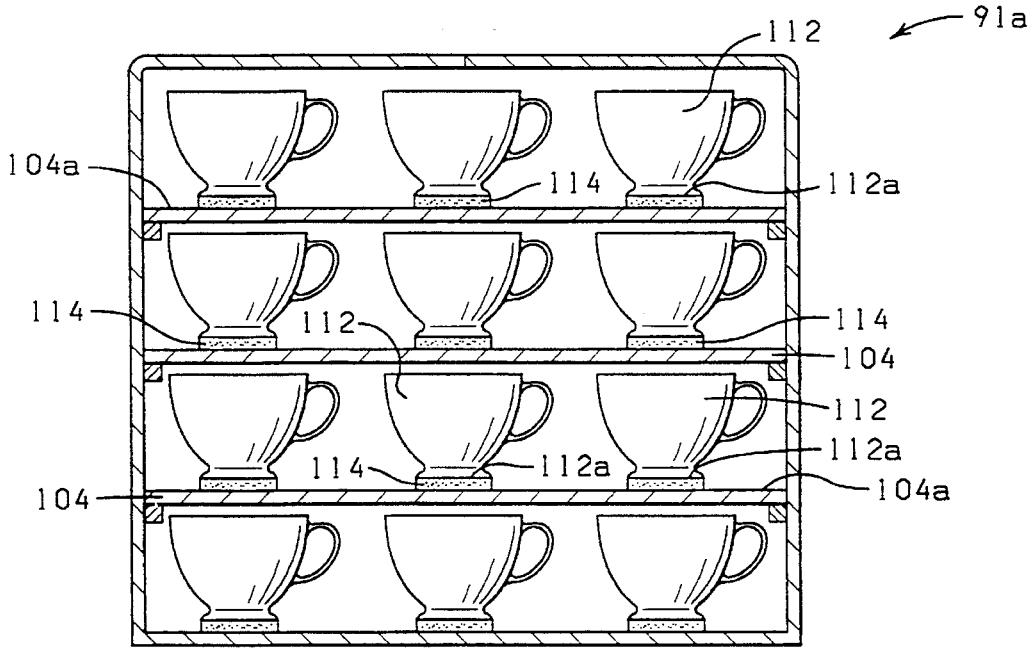
FIG. 15 is a side sectional view of an alternate set of items of china bonded to surfaces within a carton.

Shown in FIG. 15 is a version of the present invention in which a carton 91*a* contains a plurality of items of china which are cups 112. The carton 91*a* is exactly the same as carton 91 except that the contents shown disposed therein are a different type of item of china, in this case cups. A plurality of cups 112 is shown bondingly connected to the shelf 104. Also, as noted above, each cup 112 may be bonded to the shelf 104 by a connecting bonding material 114 disposed on an exterior surface 112*a* of the cup 112, on the upper surface 104*a* of the shelf 104, or on both the exterior surface 112*a* and the upper surface 104*a*.

As discussed above, each of the items of china may be bondingly connected to an interior wall, shelf or side wall via a bonding material disposed (1) directly on an exterior surface of the item, (2) on a bonding surface of the side wall, interior wall or shelf, or (3) on both the item and the interior wall or shelf. In the latter of the three cases, the bonding material is preferably a cohesive material. This embodiment of the invention is explicitly shown in FIGS. 16–18.

Figure 16:
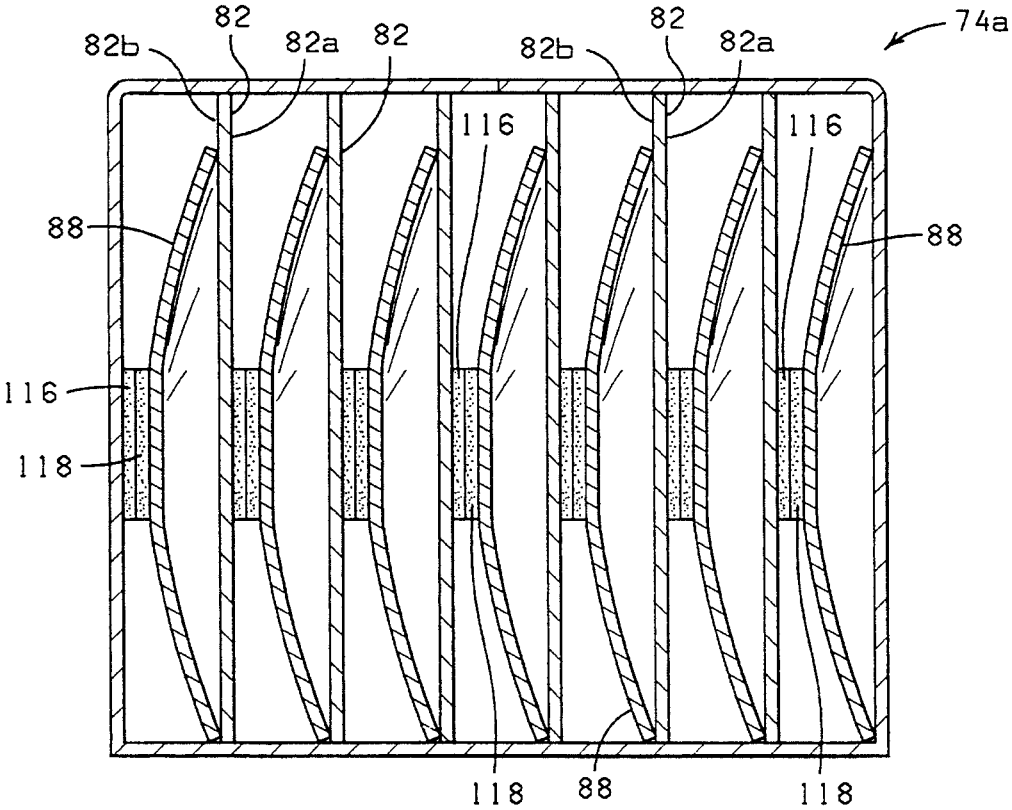
FIG. 16 is a side sectional view of a plurality of items of china oriented in the manner of FIG. 13 and bondingly connected to a plurality of support surfaces within a carton in an alternate manner.

FIG. 16 shows a carton 74*a* which is exactly the same as carton 74, containing a plurality of interior walls 82, each having a first surface 82*a* and a second surface 82*b* with an item of china 88 bondingly connected to the first surface 82*a* by a first bonding material 116 disposed on the first surface 82*a* and a second bonding material 118 disposed on the item of china 88. Although preferably the bonding materials 116 and 118 are cohesive materials, in an alternate embodiment, the bonding materials 116 and 118 could both be pressure sensitive adhesives.

Figure 17:
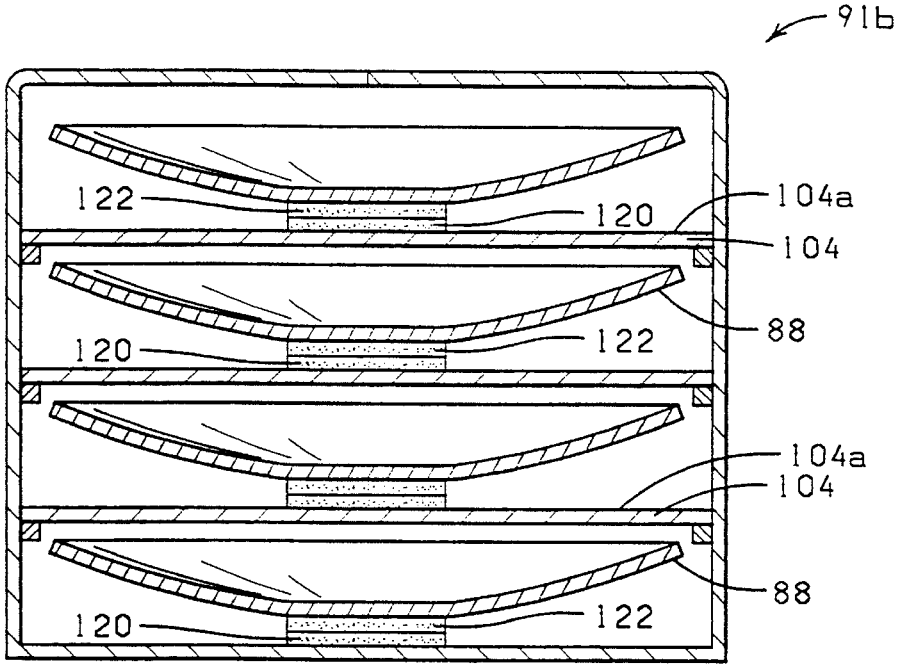
FIG. 17 is a side sectional view of a plurality of items of china oriented in the manner of FIG. 14 and bondingly connected to a plurality of support surfaces within a carton in the manner of FIG. 16.

FIG. 17 shows a carton 91*b* which is exactly the same as carton 91 containing a plurality of shelves 104, each having a bonding surface 104*a* with an item of china 88 bondingly connected thereto by a first bonding material 120 disposed on the bonding surface 104*a* and a second bonding material 122 disposed on the exterior surface of the item of china 88. As noted above, the first and second bonding materials 120 and 122 are preferably cohesive materials but may also be adhesive materials.

Figure 18:
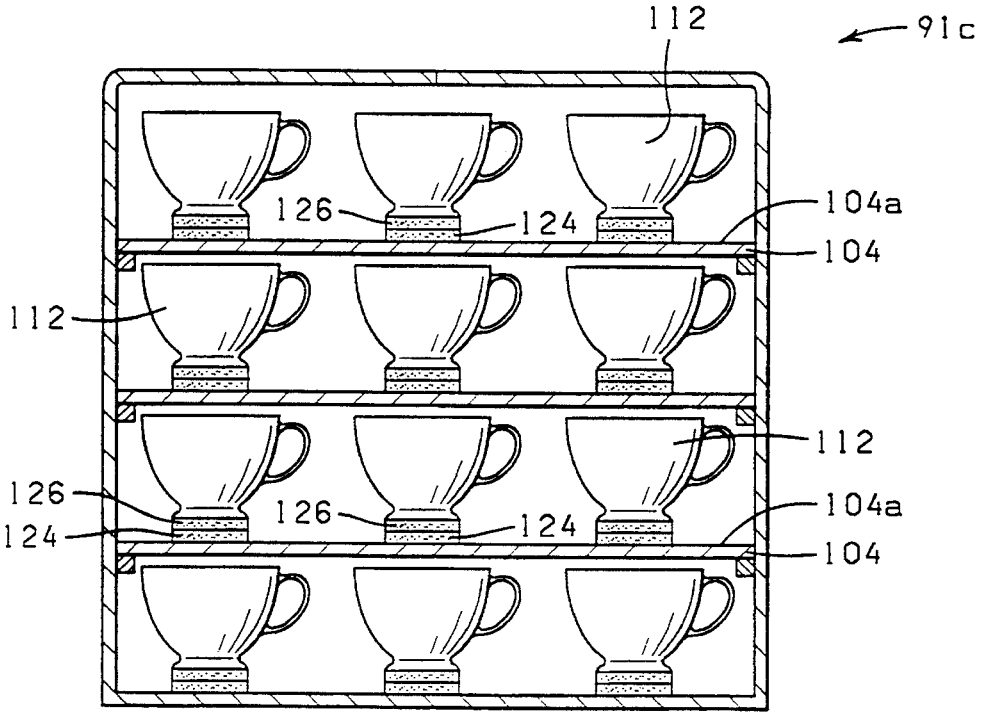
FIG. 18 is a side sectional view of a plurality of items such as those of FIG. 15 and bondingly connected to a plurality of support surfaces in the manner of FIG. 16.

FIG. 18 shows a carton 91*c* which is exactly the same as the carton 91*a* of FIG. 15 except the cup 112 and the shelf 104 are bondingly connected together via a first bonding material 124 disposed on the bonding surface 104*a* of the shelf 104 and a second bonding material 126 disposed on the exterior surface of the cup 112. As noted above, the bonding materials 124 and 126 may be adhesive materials but are preferably cohesive bonding materials. Further, as explained above, each portion of bonding material described for the embodiments herein may be covered prior to use by a release strip which can be removed prior to bondingly connecting the item to the bonding surface.

Changes may be made in the construction and the operation of the various components, elements and assemblies described herein or in the steps or the sequence of steps of the methods described herein without departing from the spirit and scope of the invention as defined in the following claims.

What is claimed is:

1. A method for delivering an item to a predetermined destination, comprising:

providing a carton having a plurality of side walls, a bottom and an interior space and having at least one bonding surface, the bonding surface having a connecting bonding material disposed upon a portion thereof;

providing an item, the item having an exterior surface engageable to the connecting bonding material;

disposing the item within the interior space of the carton and adjacent the bonding surface of the carton;

causing the exterior surface of the item to engage the connecting bonding material of the adjacent bonding surface thereby bondingly connecting the item to the adjacent bonding surface whereby the item is rendered substantially immobile within the interior space of the carton; and transporting the carton with the item contained therein to the predetermined destination.

2. The method of claim 1 wherein in the step of providing the item, the item further comprises a second connecting bonding material disposed upon a portion of the exterior surface thereof for cooperating with the connecting bonding material of the bonding surface to bondingly connect the item to the bonding surface.

3. The method of claim 2 wherein in the steps of providing the carton and providing the item, the connecting bonding material of the bonding surface and the second connecting bonding material of the item are cohesive materials.

4. The method of claim 1 wherein in the step of providing the carton the bonding surface comprises an insert disposed within the interior space of the carton, the insert having the connecting bonding material disposed upon a surface thereof.

5. The method of claim 1 wherein in the step of providing the item, the item is an item of china.

6. The method of claim 1 wherein in the step of providing the item, the item is a flower pot means.

7. The method of claim 1 comprising the additional step of removing the item from the carton after the carton has been delivered to the predetermined destination.

8. The method of claim 1 comprising the additional step of disposing a packing material within the container for cushioning the item contained therein.

9. The method of claim 1 wherein in the step of providing a carton, at least one of the side walls has a connecting bonding material disposed upon an inner surface thereof for bondingly connecting to the item.

10. The method of claim 1 wherein in the step of providing the carton, the connecting bonding material is further defined as an adhesive or cohesive.

11. A method for delivering an item to a predetermined destination, comprising:

providing a carton having a plurality of side walls, a bottom and an interior space and having at least one bonding surface, the bonding surface having a connecting bonding material disposed upon a portion thereof and the carton having a release strip disposed upon a portion of the connecting bonding material for covering at least portions of the connecting bonding material prior to the use thereof;

providing an item, the item having an exterior surface engageable to the connecting bonding material;

disposing the item within the interior space of the carton and adjacent the bonding surface of the carton;

causing the exterior surface of the item to engage the connecting bonding material of the adjacent bonding surface thereby bondingly connecting the item to the adjacent bonding surface whereby the item is rendered substantially immobile within the interior space of the carton; and transporting the carton with the item contained therein to the predetermined destination.

12. A method for delivering an item of china to a predetermined destination, comprising:

providing a carton having a plurality of side walls, a bottom and an interior space;

providing at least one insert, the insert having a bonding surface having a connecting bonding material disposed upon a portion thereof;

providing at least one item of china, the item having an exterior surface engageable with the connecting bonding material of the bonding surface of the insert;

disposing the insert into the interior space of the carton;

disposing the item of china into the interior space of the carton adjacent the insert in a position near the connecting bonding material of the insert wherein a portion of the exterior surface of the item of china is caused to engage and bondingly connect to the connecting bonding material on the insert whereby the item is rendered substantially immobile within the interior space of the carton; and transporting the carton with the items of china disposed therein to the predetermined destination.

13. The method of claim 12 wherein in the step of providing the insert, the insert provided is adapted to fit the contour of at least a portion of the exterior surface of the item of china to be bondingly connected thereto.

14. The method of claim 12 wherein in the step of providing the item of china, the item of china further comprises a second connecting bonding material disposed upon a portion of the exterior surface thereof for cooperating with the connecting bonding material of the bonding surface to bondingly connect the item of china to the bonding surface.

15. The method of claim 14 wherein in the steps of providing the carton and providing the item of china, the connecting bonding material of the bonding surface and the second connecting bonding material of the item of china are cohesive materials.

16. The method of claim 12 comprising the additional step of removing the item of china from the carton after the carton has been delivered to the predetermined destination.

17. The method of claim 12 comprising the additional step of disposing a packing material within the container for cushioning the item of china contained therein.

18. The method of claim 12 wherein in the step of providing a carton, at least one of the side walls has a connecting bonding material disposed upon an inner surface thereof for bondingly connecting to the item of china.

19. The method of claim 12 wherein in the step of providing the carton, the connecting bonding material is further defined as an adhesive or cohesive.

20. A method for delivering an item of china to a predetermined destination, comprising:

providing a carton having a plurality of side walls, a bottom and an interior space;

providing at least one insert, the insert having a bonding surface having a connecting bonding material disposed upon a portion thereof and the carton having a release strip disposed upon a portion of the connecting bonding material for covering at least portions of the connecting bonding material prior to the use thereof;

providing at least one item of china, the item having an exterior surface engageable with the connecting bonding material of the bonding surface of the insert;

disposing the insert into the interior space of the carton;

disposing the item of china into the interior space of the carton adjacent the insert in a position near the connecting bonding material of the insert wherein a portion of the exterior surface of the item of china is caused to engage and bondingly connect to the connecting bonding material on the insert whereby the item is rendered substantially immobile within the interior space of the carton; and transporting the carton with the items of china disposed therein to the predetermined destination.

21. A method for delivering an item of china to a predetermined destination, comprising:

providing a carton having a plurality of side walls, a bottom and an interior space;

providing at least one insert, the insert having a bonding surface having a connecting bonding material disposed upon a portion thereof;

providing at least one item of china, the item having an exterior surface engageable with the connecting bonding material of the bonding surface of the insert;

disposing the item of china upon the insert in a position wherein a portion of the exterior surface of the item of china is caused to engage and bondingly connect to the connecting bonding material on the insert;

disposing the insert and the item of china connectingly bonded thereto into the interior space of the carton whereby the item is rendered substantially immobile within the interior space of the carton; and transporting the carton with the items of china disposed therein to the predetermined destination.

22. The method of claim 21 wherein in the step of providing the insert, the insert provided is adapted to fit the contour of at least a portion of the exterior surface of the item of china to be bondingly connected thereto.

23. The method of claim 21 wherein in the step of providing the item of china, the item of china further comprises a second connecting bonding material disposed upon a portion of the exterior surface thereof for cooperating with the connecting bonding material of the bonding surface to bondingly connect the item of china to the bonding surface.

24. The method of claim 23 wherein in the steps of providing the carton and providing the item of china, the connecting bonding material of the bonding surface and the second connecting bonding material of the item of china are cohesive materials.

25. The method of claim 21 comprising the additional step of removing the item of china from the carton after the carton has been delivered to the predetermined destination.

26. The method of claim 21 comprising the additional step of disposing a packing material within the container for cushioning the item of china contained therein.

27. The method of claim 21 wherein in the step of providing a carton, at least one of the walls has a connecting bonding material disposed upon an inner surface thereof for bondingly connecting to the item of china.

28. The method of claim 21 wherein in the step of providing the carton, the connecting bonding material is further defined as an adhesive or cohesive.

29. A method for delivering an item of china to a predetermined destination, comprising:

providing a carton having a plurality of side walls, a bottom and an interior space;

providing at least one insert, the insert having a bonding surface having a connecting bonding material disposed upon a portion thereof and the carton having a release strip disposed upon a portion of the connecting bonding material for covering at least portions of the connecting bonding material prior to the use thereof;

providing at least one item of china, the item having an exterior surface engageable with the connecting bonding material of the bonding surface of the insert;

disposing the item of china upon the insert in a position wherein a portion of the exterior surface of the item of china is caused to engage and bondingly connect to the connecting bonding material on the insert;

disposing the insert and the item of china connectingly bonded thereto into the interior space of the carton whereby the item is rendered substantially immobile within the interior space of the carton; and transporting the carton with the items of china disposed therein to the predetermined destination.

30. A method for delivering an item of china to a predetermined destination, comprising:

providing a carton having a plurality of exterior side walls, a bottom, an interior space, and a plurality of interior walls formed from one or more inserts disposed within the interior space of the carton, each interior wall having a bonding surface with a connecting bonding material disposed upon a portion thereof;

providing a plurality of items of china, each item having an exterior surface engageable with the connecting bonding material of the bonding surface of an interior wall;

disposing the item of china into the interior space of the carton with the exterior surface of the item of china adjacent the bonding surface of an interior wall and wherein a portion of the exterior surface of the item of china is caused to engage and bondingly connect to the connecting bonding material on the interior wall whereby the item of china is rendered substantially immobile within the interior space of the carton; and transporting the carton with the items of china disposed therein to the predetermined destination.

31. The method of claim 30 wherein in the step of providing the carton, the inserts comprising the interior walls are adapted to fit the contour of at least a portion of the exterior surface of the item of china to be disposed therein.

32. The method of claim 30 wherein in the step of providing the item of china, the item of china further comprises a second connecting bonding material disposed upon a portion of the exterior surface thereof for cooperating with the connecting bonding material of the bonding surface of the interior wall to bondingly connect the item of china to the bonding surface.

33. The method of claim 32 wherein in the steps of providing the carton and providing the item of china, the connecting bonding material of the bonding surface and the second connecting bonding material of the item of china are cohesive materials.

34. The method of claim 30 comprising the additional step of removing the item of china from the carton after the carton has been delivered to the predetermined destination.

35. The method of claim 30 comprising the additional step of disposing a packing material within the container for cushioning the items of china contained therein.

36. The method of claim 30 wherein in the step of providing a carton, at least one of the exterior side walls has a connecting bonding material disposed upon an inner surface thereof for bondingly connecting to the item of china.

37. The method of claim 30 wherein in the step of providing the carton, the connecting bonding material is further defined as an adhesive or cohesive.

38. A method for delivering an item of china to a predetermined destination, comprising:

providing a carton having a plurality of exterior side walls, a bottom, an interior space, and a plurality of interior walls formed from one or more inserts disposed within the interior space of the carton, each interior wall having a bonding surface with a connecting bonding material disposed upon a portion thereof and the carton having a release strip disposed upon a portion of the connecting bonding material for covering at least portions of the connecting bonding material prior to the use thereof;

providing a plurality of items of china, each item having an exterior surface engageable with the connecting bonding material of the bonding surface of an interior wall;

disposing the item of china into the interior space of the carton with the exterior surface of the item of china adjacent the bonding surface of an interior wall and wherein a portion of the exterior surface of the item of china is caused to engage and bondingly connect to the connecting bonding material on the interior wall whereby the item of china is rendered substantially immobile within the interior space of the carton; and transporting the carton with the items of china disposed therein to the predetermined destination.

39. A method for delivering an item to a predetermined destination, comprising:

providing a carton having a bottom and having at least one bonding surface, the bonding surface having a connecting bonding material disposed upon a portion thereof and the carton having a release strip disposed upon a portion of the connecting bonding material for covering at least portions of the connecting bonding material prior to the use thereof;

providing an item, the item having an exterior surface engageable to the connecting bonding material;

disposing the item adjacent the bonding surface of the carton;

causing the exterior surface of the item to engage the connecting bonding material of the adjacent bonding surface thereby bondingly connecting the item to the adjacent bonding surface whereby the item is rendered substantially immobile; and transporting the carton with the item to the predetermined destination.

40. The method of claim 39 wherein in the step of providing the item, the item is a flower pot means.

41. The method of claim 39 wherein in the step of providing the carton, the carton further comprises a release strip for covering the connecting bonding material prior to use of the connecting bonding material to bondingly connect bond to an item.

42. The method of claim 39 wherein in the step of providing the carton, the connecting bonding material is further defined as an adhesive or cohesive.

43. The method of claim 39 wherein the bottom comprises the bonding surface.

44. The method of claim 39 wherein in the step of providing the item, the item further comprises a second connecting bonding material disposed upon a portion of the exterior surface thereof for cooperating with the connecting bonding material of the bonding surface to bondingly connect the item to the bonding surface.

45. The method of claim 44 wherein in the steps of providing the carton and providing the item, the connecting bonding material of the bonding surface and the second connecting bonding material of the item are cohesive materials.

46. The method of claim 39 wherein in the step of providing the item, the item is an item of china.

* * * * *

UNITED STATES PATENT AND TRADEMARK OFFICE

CERTIFICATE OF CORRECTION

PATENT NO. : 5,522,205

DATED : June 4, 1996

INVENTOR(S) : Donald E. Weder

It is certified that error appears in the above-indentified patent and that said Letters Patent is hereby corrected as shown below:

Cover page, Related U.S. Application Data, seventh line, please delete "continuation" and substitute therefor --continuation-in-part--.

In the drawings, Figure 3, please delete element numeral "48" and substitute therefor --47-- as shown below.

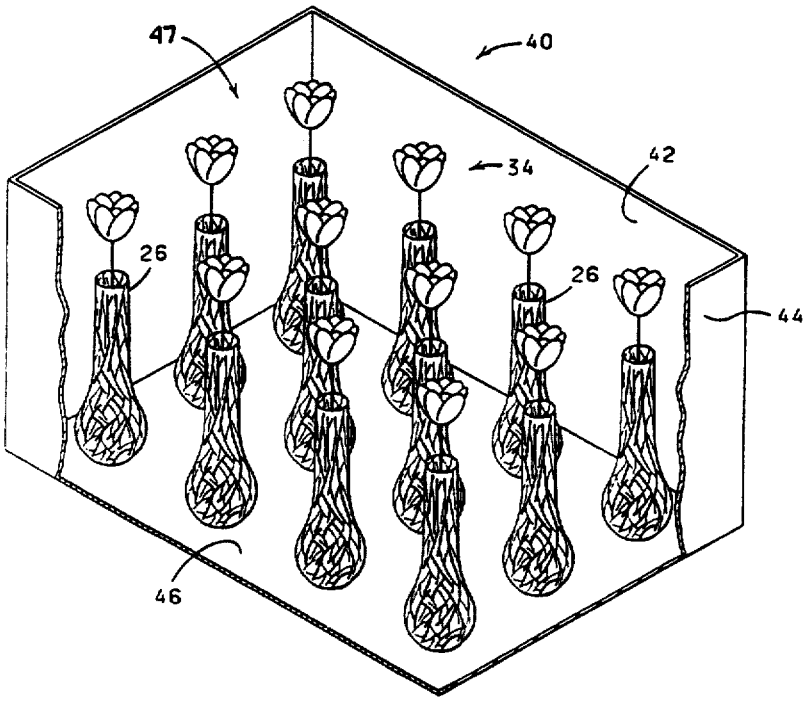

FIG. 3

UNITED STATES PATENT AND TRADEMARK OFFICE

CERTIFICATE OF CORRECTION

PATENT NO. : 5,522,205

DATED : June 4, 1996

INVENTOR(S) : Donald E. Weder

It is certified that error appears in the above-identified patent and that said Letters Patent is hereby corrected as shown below:

Column 2, line 52, after "comprise" please delete ",".

Column 3, line 9, after "number" please insert --of--.

Column 3, line 54, after "comprises" please delete ",".

Column 5, line 56, please delete "The vase 26 in" and substitute therefor --In--.

Column 8, line 3, please delete "inner retaining space 48" and substitute therefor --inner retaining space 47--.

Column 9, line 25, please delete "carbon 40b" and substitute therefor --carton 40b--.

Column 9, lines 27-28, please delete "inner bottom surface 46b" and substitute therefor --lower end 30--.

Column 10, line 4, please delete "sheets of material 46a" and substitute therefor --sheets of material 68a--.

Column 10, line 8, please delete "as FIG. 26" and substitute therefor --in FIG. 10--.

UNITED STATES PATENT AND TRADEMARK OFFICE

CERTIFICATE OF CORRECTION

PATENT NO. : 5,522,205

DATED : June 4, 1996

INVENTOR(S) : Donald E. Weder

It is certified that error appears in the above-indentified patent and that said Letters Patent is hereby corrected as shown below:

Column 18, line 37, please delete "bond".

Signed and Sealed this

Twenty-fourth Day of December, 1996

*Attest:*

Bruce Lehman

BRUCE LEHMAN

*Attesting Officer*

*Commissioner of Patents and Trademarks*